United States Patent [19]

Stuck

[11] Patent Number: 4,640,079

[45] Date of Patent: Feb. 3, 1987

[54] DEVICE FOR PACKAGING PLANTS

[75] Inventor: Matthew A. Stuck, Menasha, Wis.

[73] Assignee: Modern Mfg. Co. Inc., Menasha, Wis.

[21] Appl. No.: 800,030

[22] Filed: Nov. 20, 1985

[51] Int. Cl.[4] ..... B65B 67/08

[52] U.S. Cl. ..... 53/390; 53/241; 269/37

[58] Field of Search ..... 53/390, 241; 269/37, 269/47, 237; 211/71, 72, 45; 221/282

[56] References Cited

U.S. PATENT DOCUMENTS

| | | | |
|---|---|---|---|
| 1,183,454 | 5/1916 | Hayashi | 53/241 |
| 1,365,516 | 1/1921 | Luellen | 221/282 |
| 2,590,742 | 3/1952 | Williams | 226/18 |
| 2,971,312 | 2/1961 | Bell, Jr. | 53/390 |
| 2,989,828 | 6/1961 | Warp | 53/390 |
| 3,360,901 | 1/1968 | Gallo | 53/390 |
| 3,431,706 | 3/1969 | Stuck | 53/390 |
| 3,747,293 | 7/1973 | Van Slooten et al. | 53/390 X |
| 4,242,834 | 1/1981 | Olsen | 211/72 X |
| 4,280,314 | 7/1981 | Stuck | 53/241 |

FOREIGN PATENT DOCUMENTS

| | | |
|---|---|---|
| 2107006 | 2/1971 | Fed. Rep. of Germany . |
| 1244932 | 6/1960 | France . |
| 587067 | 7/1959 | Italy . |
| 1026259 | 4/1966 | United Kingdom . |

*Primary Examiner*—James F. Coan

*Attorney, Agent, or Firm*—Andrus, Sceales, Starke & Sawall

[57] ABSTRACT

A device for packaging plants including a base, and a vertical column is mounted on the base and carries a generally conical sleeve support. A multiplicity of nested paper or plastic sleeves are carried by the sleeve support. A pedestal extends upwardly from the base through the conical support, as well as through the nested sleeves, and a platform is mounted on the upper end of the pedestal. With a potted plant supported on the platform, the innermost sleeve is drawn upwardly around the plant to bring the lower end of the sleeve into engagement with the rim of the pot to enclose the plant in the sleeve.

8 Claims, 3 Drawing Figures

FIG. 1
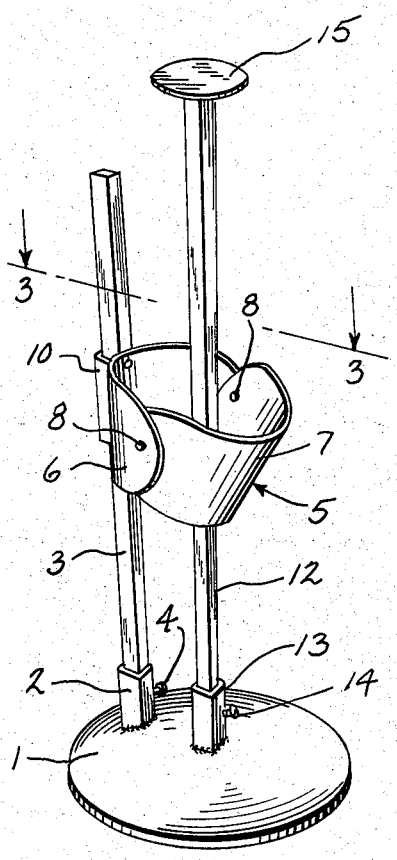
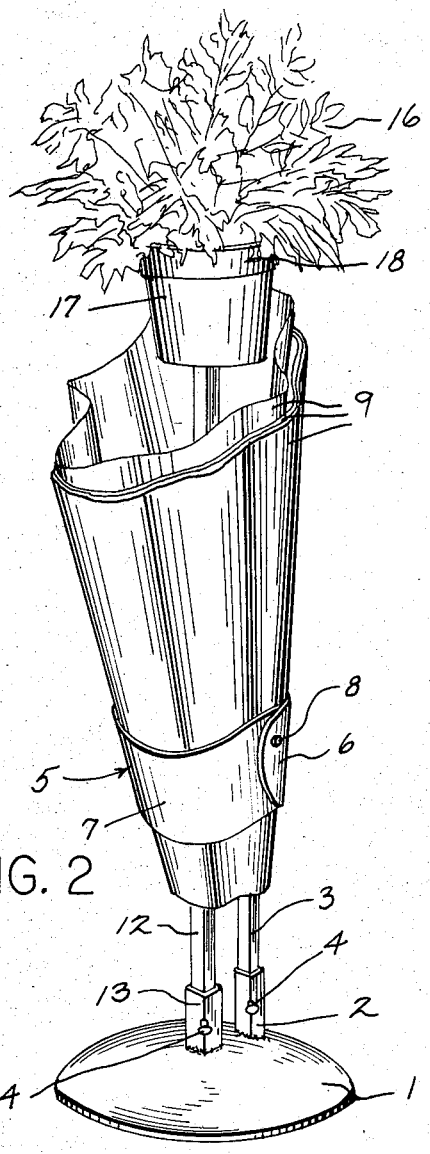
FIG. 2
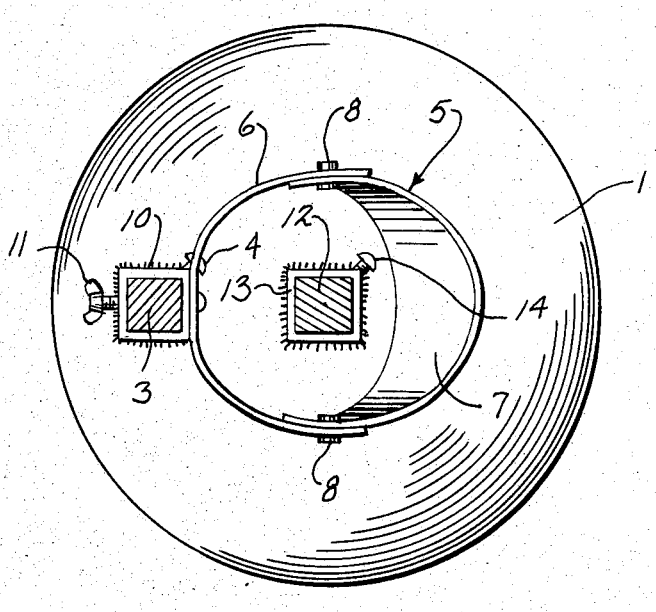
FIG. 3

DEVICE FOR PACKAGING PLANTS

BACKGROUND OF THE INVENTION

Potted plants are frequently packaged for shipment in generally conical paper or plastic sleeves, by growers, distributors, or retail florists. The sleeves can vary in height and degree of taper depending upon the size and configuration of the plant to be packaged.

In the past, the practice in packaging a plant has been to hold the sleeve in the open condition and drop the plant into the sleeve from the open upper end. This procedure of holding the sleeve open, dropping the plant into the sleeve and catching the plant, is rather difficult and frequently results in damage to the plant or its foliage.

SUMMARY OF THE INVENTION

The invention is directed to a device for packaging potted plants. In accordance with the invention, the device includes a base, and a vertical column is mounted on the base and carries a generally conical sleeve support. A group of open ended, tapered, paper or plastic sleeves are nested in the sleeve support.

Extending upwardly from the base is a pedestal which extends through the conical support and through the nested sleeves. A platform is mounted on the upper end of the pedestal to support a plant to be potted. With the plant supported on the platform, the innermost sleeve is manually drawn upwardly around the plant to bring the lower end of the sleeve into engagement with the rim of the pot to enclose the plant in the sleeve.

The conical sleeve support is formed of two generally C-shaped members with the adjacent ends of the C-shaped members being disposed in lapping relation and pivotally connected together around horizontal axes. This construction automtically enables the sleeve support to conform to the taper of the sleeves being utilized.

In addition, the sleeve support is adjustably mounted for vertical movement on the vertical column to thereby enable the device to accommodate sleeves of various height, which can vary from about 15 to 36 inches.

The packaging device of the invention enables potted plants to be packaged at a substantially faster rate without damage to the foliage, thereby resulting in a considerable labor and product savings.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of a packaging device of the invention;

FIG. 2 is a view similar to FIG. 1 showing a plurality of nested sleeves supported on the device and a plant mounted in position for packaging; and FIG. 3 is a horizontal section taken along line 3—3 of FIG. 1.

DESCRIPTION OF THE ILLUSTRATED EMBODIMENT

FIG. 1 shows a device for packaging potted plants that includes a generally circular base 1 having an upstanding socket 2 which receives the lower end of a generally vertical column 3. The lower end of column 3 can be secured in socket 2 by means of a set screw 4.

A generally frustoconical sleeve support member 5 is adjustably mounted on column 3. Support member 5 includes a pair of generally C-shaped sections 6 and 7. The ends of the sections 6 and 7 are disposed in lapping relation and are connected together by rivets or pins 8 which constitute a pivotal connection between the sections.

As shown in FIG. 2, support member 5 is adapted to hold a group of nested plastic or paper, tapered sleeves 9. Depending upon the size and nature of the plant being packaged, the taper of the sleeves 9 can vary considerably and the pivotal connection between the sections 6 and 7 will automatically conform the support member 5 to the taper of the sleeves.

Sleeve support member 5 is mounted for vertical sliding movement on column 3 to accommodate sleeves of varying length. To provide this sliding connection, a generally box-shaped guide 10 is welded to section 6 and is slidable on column 3. The guide can be locked in any desired position through use of a set screw 11.

Extending upwardly through the sleeve support member 5 and the nested sleeves 9 is a rod or pedestal 12. The lower end of pedestal 12 is mounted in an upstanding socket 13 on base 1 and is secured to the socket through set screw 14. The upper end of pedestal 13 carries a plate or platform 15 and a plant 16 potted in pot 17 is adapted to rest on platform 15.

In use, the plant 16 in pot 17 is placed on platform 15 and the innermost of the nested sleeves 9 is then drawn upwardly around the plant until the lower end of the sleeve 9 engages the upper rim 18 of pot 17. With the lower end of the sleeve engaged with the rim 18, the plant 16 will be completely enclosed in the sleeve and the packaged plant can then be removed from the platform 15.

The packaging device of the invention enables the plants to be packaged at a much faster rate than other procedures as used in the past, thereby substantially reducing the labor costs of packaging. The labor saving is particularly evident to growers and wholesalers who may package hundreds or thousands of plants daily.

The device can be readily adapted for use with sleeves of various lengths and taper. Adjusting the position of the sleeve support member 5 on column 3 will accommodate sleeves of various lengths, while the pivotal connection of sections 6 and 7 will automatically accommodate sleeves of varying taper.

Various modes of carrying out the invention are contemplated as being within the scope of the following claims particularly pointing out and distinctly claiming the subject matter which is regarded as the invention.

I claim:

1. A device for packaging potted plants, comprising a base, a column extending upwardly from the base, a tubular support member mounted on the column, said support member being generally frustoconical in shape and having a side wall tapering downwardly and inwardly and having a pair of open ends, said support member disposed to support at least one open-ended tapered sleeve, a pedestal extending upwardly from the base and extending through said support member and through said sleeve, and a platform mounted on the upper portion of said pedestal and located above said support member, said sleeve being drawn upwardly from the support member around said plant supported on the platform to enclose said plant in said sleeve.

2. The device of claim 1, and including positioning means for adjusting the vertical position of said support member on said column.

3. The device of claim 1, and including adjusting means for adjusting the taper of said support member.

4. The device of claim 1, wherein said support member is composed of two generally C-shaped sections, and said support member includes means for pivotally connecting the adjacent ends of said sections together.

5. A device for packaging potted plants, comprising a base, a column extending upwardly from the base, a tubular generally frustoconical support member carried by the column, said support member including two generally C-shaped sections with each section having a pair of ends, corresponding ends of said sections disposed in lapping relation, said support member also including pivotal means for pivotally connecting the lapping ends about horizontal axes, a plurality of nested open ended tapered sleeves carried by said support member, a pedestal extending upwardly from said base and extending through said support member and through said nested sleeves, and a platform mounted on the upper end of said pedestal for supporting a potted plant to be packaged, the innermost sleeve of said nested sleeves being drawn upwardly around said plant supported on said platform to thereby enclose said plant in said sleeve.

6. The device of claim 5, and including positioning means for adjusting the vertical position of said sleeve support member on said column.

7. The device of claim 5, wherein said platform is located a substantial distance above said sleeve support member.

8. The device of claim 6, wherein said positioning means includes a guide connected to said support member and slidable on said column, and locking means for collectively locking said guide to said column.

* * * * *